US006574807B1

(12) United States Patent
Gonzalez

(10) Patent No.: US 6,574,807 B1
(45) Date of Patent: Jun. 10, 2003

(54) FURNITURE BED

(76) Inventor: Alejandro E. Gonzalez, 6423 Collins Ave., apt. 302, Miami Beach, FL (US) 33141

( * ) Notice: Subject to any disclaimer, the term of this patent is extended or adjusted under 35 U.S.C. 154(b) by 0 days.

(21) Appl. No.: 10/017,345

(22) Filed: Dec. 14, 2001

(51) Int. Cl.[7] ..... A47C 17/58

(52) U.S. Cl. ..... 5/159.1; 5/160; 5/164.1; 5/162; 5/149

(58) Field of Search ..... 5/154, 149, 159.1, 5/160, 164.1, 167, 170; 16/32, 34

(56) References Cited

U.S. PATENT DOCUMENTS 1,451,181 A * 4/1923 Scott ..... 5/167
1,528,031 A * 3/1925 Smith ..... 5/119
1,723,649 A * 8/1929 Heath ..... 5/140
2,788,528 A * 4/1957 Hansen ..... 5/6
2,908,031 A * 10/1959 Millett et al. ..... 16/31
3,088,127 A * 5/1963 Eames ..... 5/2.1
3,534,430 A * 10/1970 Kesling et al. ..... 16/31
4,476,592 A * 10/1984 Reppas et al. ..... 5/164.1
4,783,879 A * 11/1988 Weaver ..... 16/34

* cited by examiner

*Primary Examiner*—Michael F Trettel
(74) *Attorney, Agent, or Firm*—J. Sanchelima; A. Bordas

(57) ABSTRACT

An improved furniture bed assembly primarily comprising a housing having a caster assembly, a stationary frame assembly and a bed frame assembly. Housed within and secured to the housing, the bed frame assembly has means to fold within the furniture housing. The caster assembly is a retractable wheel assembly to facilitate movement of the instant invention. To use the bed assembly, a user opens the housing, exposing the bed. The user pulls the bed assembly partially out of the furniture housing allowing the bed frame assembly to lock in place, to allow the user to safely and comfortably lay down and rest on the bed.

6 Claims, 5 Drawing Sheets

FURNITURE BED

II. BACKGROUND OF THE INVENTION

1. Field of the Invention

The present invention relates to a bed, and more particularly, to an improved furniture bed assembly that is mobile.

2. Description of the Related Art

Many designs for beds have been designed in the past. None of them, however, include a furniture bed assembly that is easily mobile. The instant invention primarily comprises a housing having a caster assembly, a stationary frame assembly and a bed frame assembly. Housed within and secured to said housing, the bed frame assembly has means to fold within the housing. The caster assembly is a retractable assembly to facilitate movement of the instant invention. To use the bed assembly, a user opens the doors of the housing, exposing the bed and pulls the bed assembly partially out of the housing, allowing the bed frame assembly to lock in place. This allows the user to safely utilize the bed.

There are no similar furniture bed assemblies to the best of applicant's knowledge, that have built in locking mechanisms to secure the frame of the bed within a housing and have an independent retractable caster assembly to facilitate movement of the furniture bed assembly. When retracted, the caster assembly is neatly tucked within the housing, providing a flat bottom that is more stable.

Other patents describing the closest subject matter provide for a number of more or less complicated features that fail to solve the problem in an efficient and economical way. None of these patents suggest the novel features of the present invention.

III. SUMMARY OF THE INVENTION

A furniture bed assembly comprising a housing having first, second, third, and fourth walls contiguously connected and perpendicularly disposed with respect to contiguously connected walls and having first and second ends. The housing further has a fifth wall at the first end and a sixth wall a first predetermined distance from the first end towards the second end without reaching the second end, defining a space therein. The first wall has at least one access door secured to the housing and the third wall has first and second openings.

The housing further comprises a caster assembly. The caster assembly has a stationary frame member with first and second swivel legs and a moving frame member.

The instant invention also has a stationary frame assembly, which is secured to the housing, and a bed frame assembly. The bed frame assembly, which may be stored into the housing, has a mattress and locking means to lock to the stationary frame assembly when the bed frame assembly is fully extended from the housing.

The locking means includes an operational member sliding into a latch assembly of the stationary frame assembly, to lock the bed frame assembly to the stationary frame assembly when the bed frame assembly is fully extended from the housing. The locking means further includes a handle secured to the bed frame assembly having a cord with third and fourth ends. The third end is secured to the handle and the fourth end is secured to the operational member. When a user pulls the handle, it causes the operational member to slide out of the latch assembly. This unlocks the bed frame assembly from the stationary frame assembly, allowing the bed frame assembly to be stored within the housing.

The instant invention also has rotating means for rotating the first and second swivel legs through the first and second openings, so that the first and second swivel legs may selectively be brought in alignment against the moving frame member, thereby elevating the housing. This permits for the mobility of the housing on the caster assembly. To rotate the swivel legs a tool is utilized, which is insertable through the first and second openings. In operation, a user exerting a rotational force may configure the caster assembly selectively from a retracted position to an extended position and vice-a-versa.

In addition, the stationary frame assembly and the bed frame assembly have springs to facilitate the storage of the bed frame assembly within the housing.

It is therefore of the main objects of the present invention to provide an improved furniture bed that is comfortable for the user.

It is another object of this invention to provide an improved furniture bed that is easy to maneuver.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

Figure 4A:
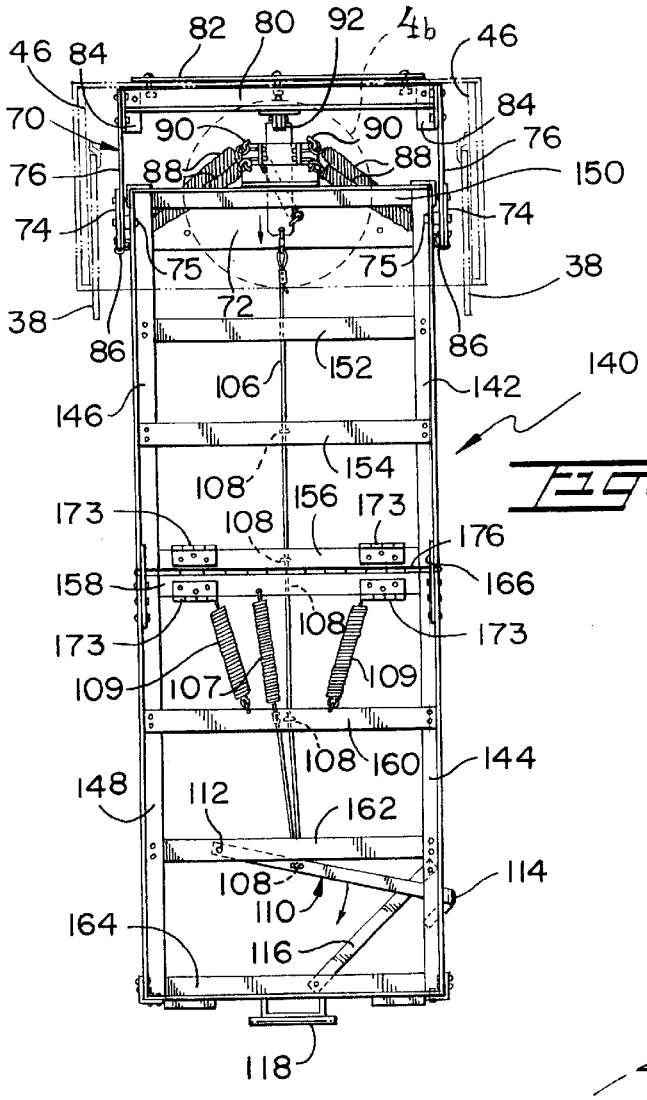

FIG. 4*a* is a top view of the frame and bed frame assembly without the mattress and foundation.

Figure 4B:
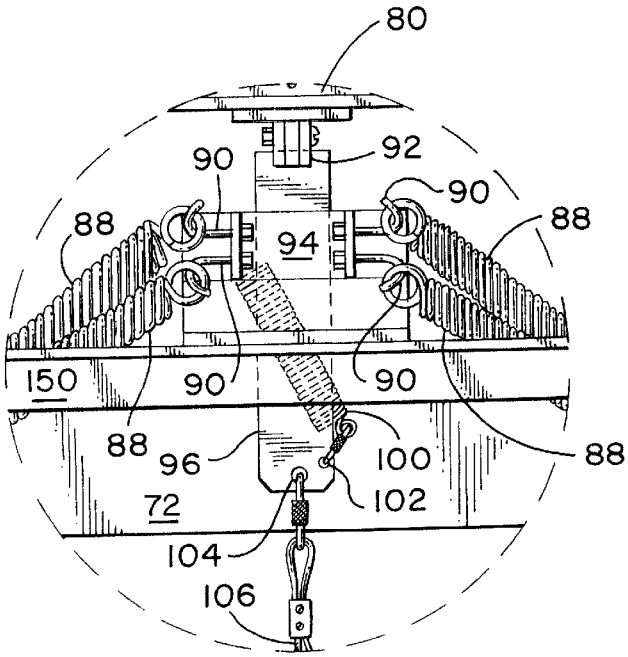

FIG. 4*b* shows a view of the bed frame locking mechanism.

Figure 5A:
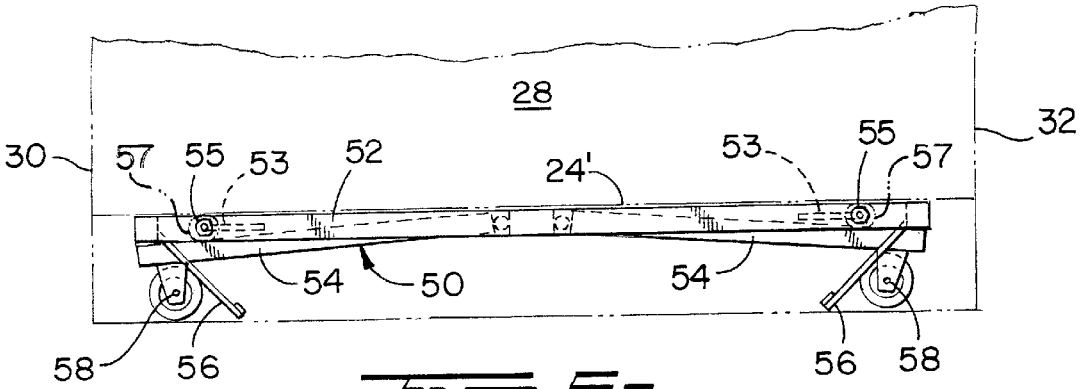

FIG. 5*a* shows the housing caster assembly in a retracted position.

Figure 5B:
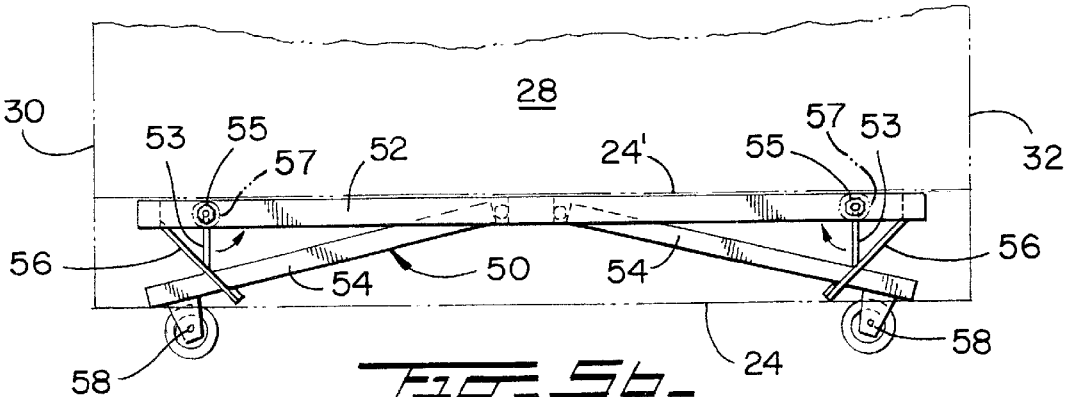

FIG. 5*b* shows the housing caster assembly in an extended position.

Figure 5C:
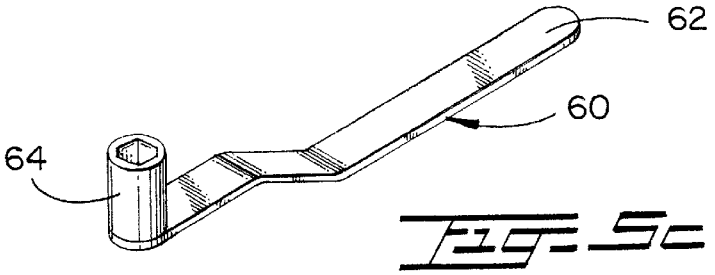

FIG. 5*c* shows the tool to operate the housing caster assembly.

Figure 6C:
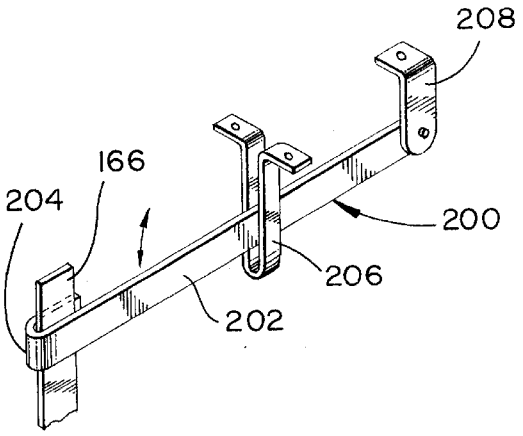
Figure 6A:
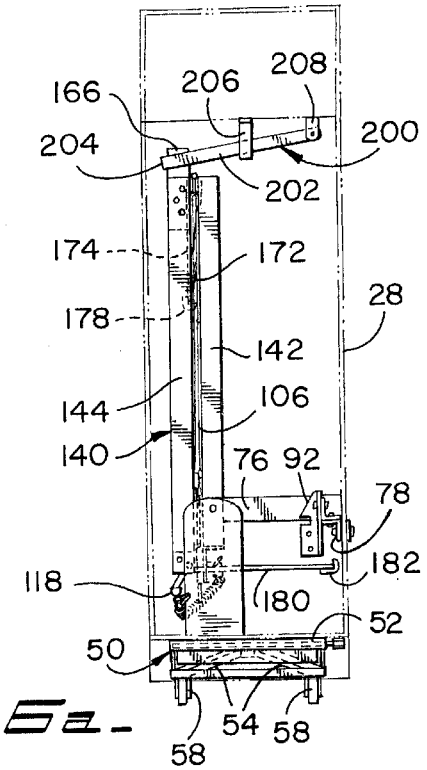

FIG. 6*a* shows an isometric side view of the instant invention with the bed assembly retracted.

Figure 6B:
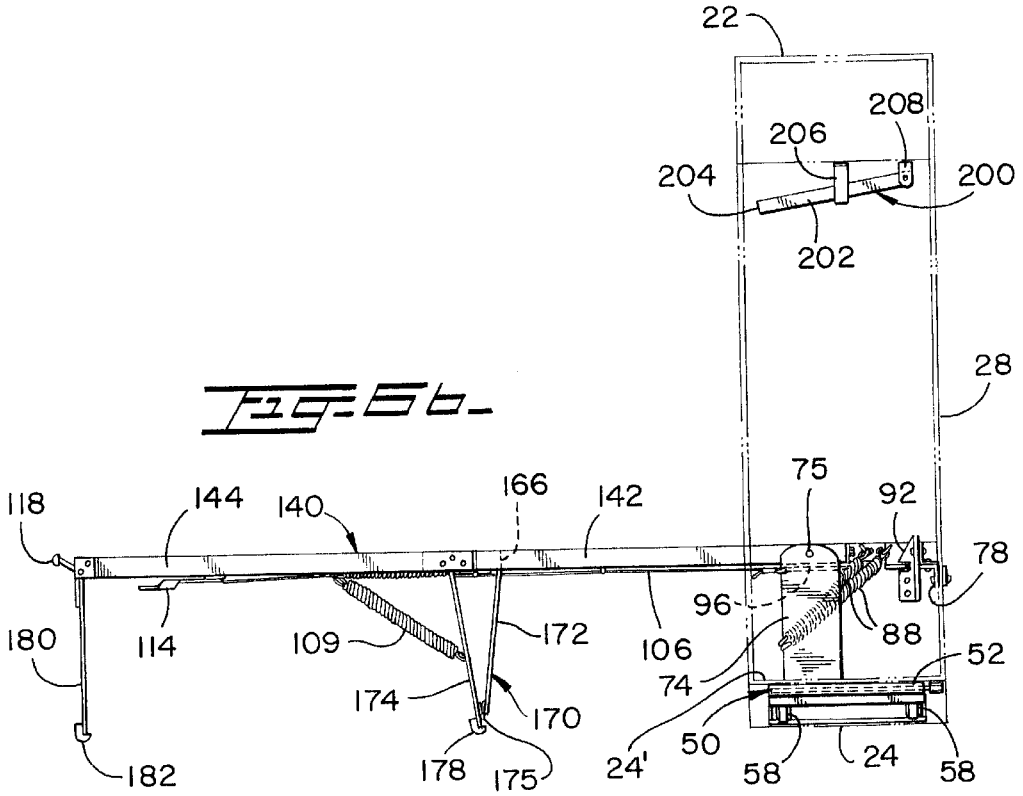

FIG. 6*b* shows an isometric side view of the instant invention with the bed assembly fully extended.

FIG. 6*c* shows the bed frame latching assembly.

Figures 3, 7:
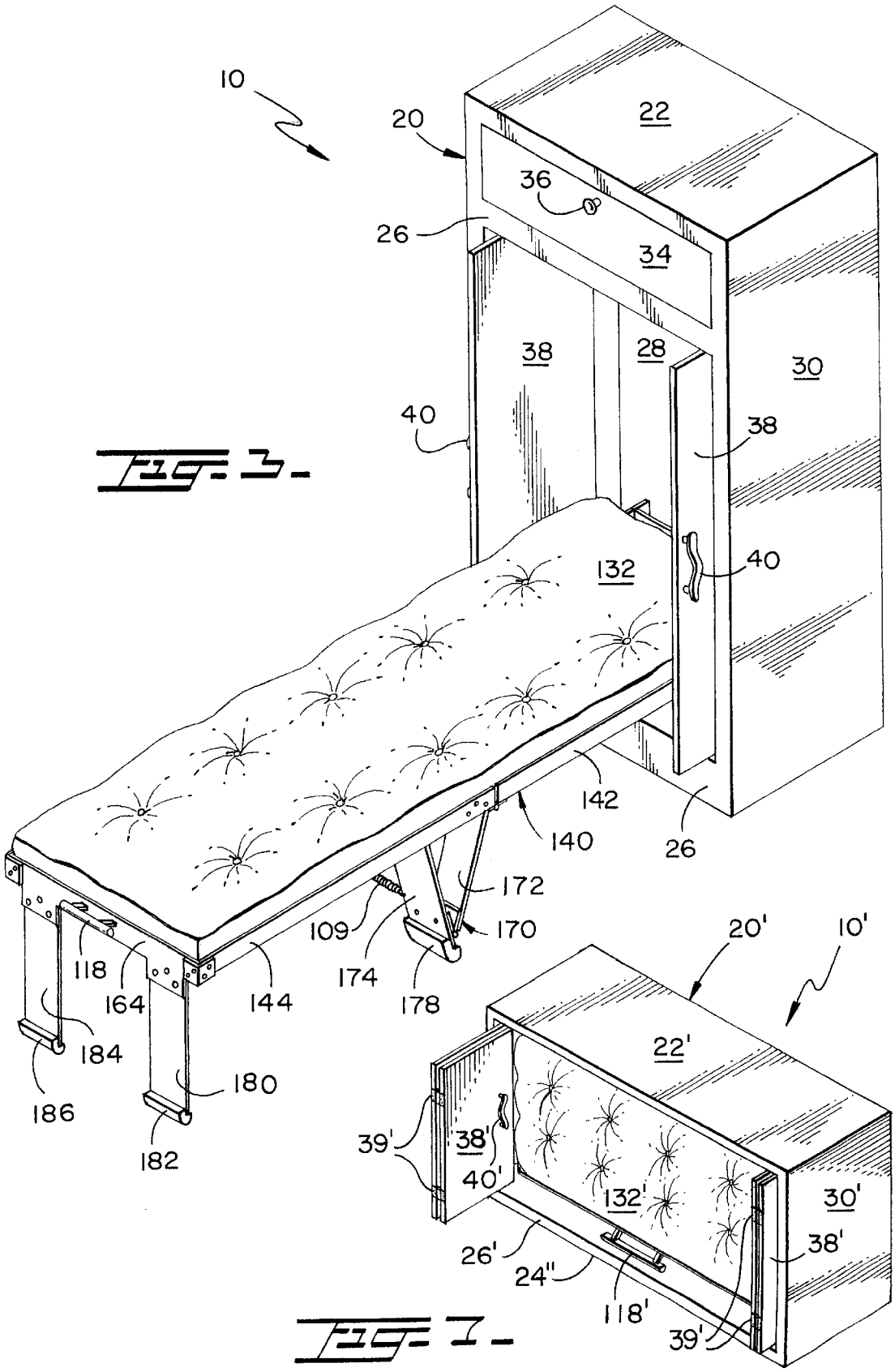
FIG. 3 illustrates the bed assembly fully extended from the housing.

FIG. 7 shows a perspective view of an alternate embodiment of the housing with its doors open.

V. DETAILED DESCRIPTION OF THE PREFERRED EMBODIMENT

Referring now to the drawings, where the present invention is generally referred to with numeral 10, it can be observed that it basically includes housing 20, caster assembly 50, frame assembly 70, and bed frame assembly 140.

Figure 1:
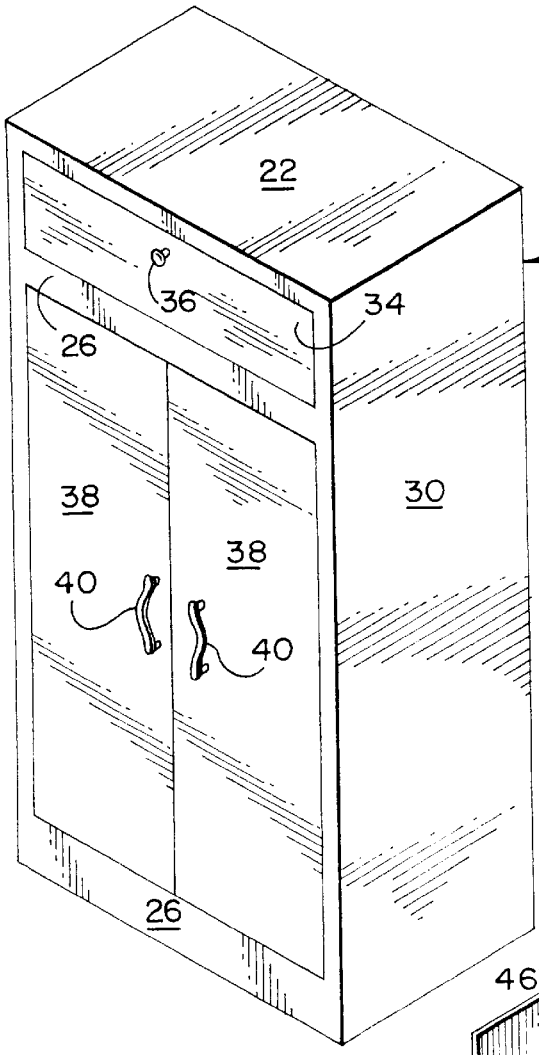
FIG. 1 represents a perspective view of the instant invention.

As seen in FIG. 1, housing 20 is a furniture piece. In this embodiment, housing 20 has a substantially rectangular shape defined by panels 26; 30 and panels 28 and 32 shown in FIG. 5*a*, establishing a parallel and spaced apart relationship between top panel 22 and bottom border 24, shown in FIG. 6*b*. In the preferred embodiment, panel 26 has doors 38. Handles 40 are ergonomically designed to allow a user to easily open doors 38. In addition, panel 26 has door 34, with its respective handle 36. Door 34 may be utilized as an access for storage space. Various combinations of doors and handles may be utilized on housing 20.

Figure 2:
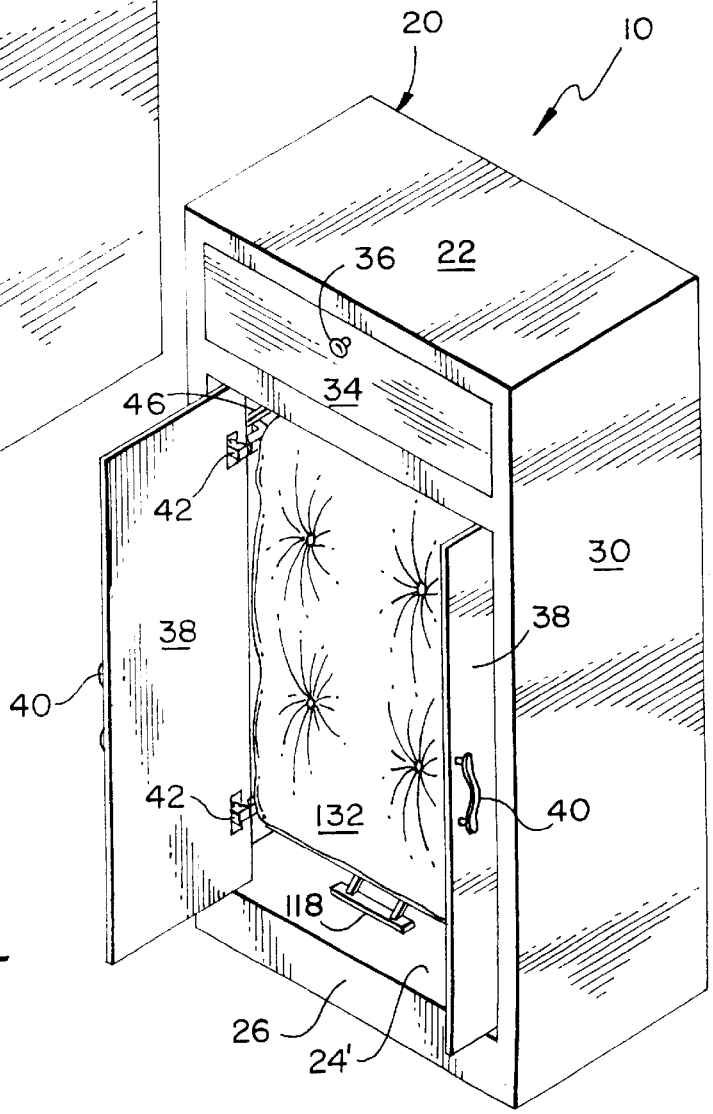
FIG. 2 shows a perspective view of the housing with its doors open.

As seen in FIG. 2, doors 38 have been opened, exposing mattress 132 within housing 20. In the illustrated embodiment, doors 38 have hinges 42. Hinges 42 have cooperative characteristics to slide within tracks 46, best seen in FIG. 4*a*. Handle 118 connects to bed frame assembly 140, seen in FIG. 3, and is pulled upon to extend bed frame assembly 140 out of housing 20.

As seen in FIG. 3, doors 38 are fully retracted within, and bed frame assembly 140 is fully extended from housing 20. Below mattress 132 is a foundation pad, not seen. In the preferred embodiment, mattress 132 is a feathered mattress and the foundation pad is one that provides sufficient cushion to properly distribute the weight of the user, allowing for comfort while utilizing the instant invention. Support leg assembly 170 and legs 180 and 184 support bed frame assembly 140 when extended. Legs 180 and 184 extend from support member 164. Legs 180 and 184 are stationary and have pads 182 and 186 respectively to properly grip flooring and prevent flooring damage.

Seen in FIG. 4*a* is frame assembly 70, and bed frame assembly 140 in the fully extended position. Frame assembly 70 is fastenly secured to housing 20. Frame assembly 70 comprises base member 72 horizontally extending across the inside face of bottom panel 24', seen in FIG. 6*b*. Extending perpendicularly upward from both ends of base member 72 are legs 74. Extending rearwardly from legs 74 are elongated members 76, which connect to top support member 80 and rear support member 78, seen in FIG. 6*a*. Providing additional support for the attachment between elongated members 76 to top support member 80 and rear support member 78, are side support members 84. For stabilization and to establish a proper base, frame assembly 70 also comprises rear support member 82, which is bolted from the outside face of rear panel 28 to rear support member 78.

Frame assembly 70 cooperates with bed frame assembly 140, allowing bed frame assembly 140 to retract within and extract from housing 20. Bed frame assembly 140 comprises elongated members 142; 144; 146; and 148, perpendicularly disposed with respect to top support member 80. Elongated members 142 and 144 are parallel and equally spaced apart from elongated members 146 and 148 by support members 150; 152; 154; 160; 162; 164; and hinge support members 156 and 158. Support members 150; 152; 154; 160; 162; 164; and hinge support members 156 and 158 may be riveted, bolted, or secured by similar means to the elongated members. Additionally, connecting legs 174, seen in FIG. 6*b*, to support member 160 are retract springs 109. Retract springs 109 connect to each leg 174 at a predetermined distance from the end of leg 174. At a predetermined distance from support member 150, elongated members 142 and 146 are secured to frame assembly 70 with pins 75, which trespass therethrough. Pins 75 allow bed frame assembly 140, and particularly elongated members 142 and 146 to swivel about frame assembly 70. Hinge 176 and leg hinges 173 allow hinge support members 156 and 158 of bed frame assembly 70 to fold, for storage.

Operationally connecting frame assembly 70 to bed frame assembly 140 is latch 92, best seen in FIG. 4*b*. Operational member 96, seen in FIG. 4*b*, slides in and out of latch 92. Extending from operational member 96 is cable 106. Cable 106 travels through guides 108, which in this embodiment, are secured on the underside of support members 154; 160; hinge support members 156; 158, handle 110, and terminates at one end of return spring 107. Handle 110 is elongated in shape, hingedly secured to support member 162 at end 112, and supported by support bracket 116, which is diagonally connected from elongated member 144 to support member 164. End 114 of handle 110 may slightly protrude sidewardly from elongated member 144 to ergonomically assist a user to reach and pull it. Return spring 107 is connected at one end to hinge support member 158 and at the other end to cable 106. Handle 118 is fixed to support member 164 and is independent from handle 110.

As seen in FIG. 4*b*, cable 106 is secured to operational member 96 at hole 104. In this embodiment, operational member 96 slides beneath base member 72 and connector 94. Operational member 96 also has return spring 100, which connects from hole 102 to an anchor 90. When pulled by cable 106, operational member 96 slides out from latch 92. Return spring 100 keeps operational member 96 secure within latch 92, to prevent it from unlocking. Anchors 90 are secured to connector 94 and secure retract springs 88. Retract springs 88 are secured on their other end to anchors 86, which are bolted to legs 74.

Seen in FIG. 5*a*, is caster assembly 50 in the retracted position. Caster assembly 50 comprises stationary member 52 bolted to or affixed by similar means, to bottom panel 24'. Hingedly secured to stationary member 52 are moving members 54. Also interacting with moving members 54 are swivel legs 53, which lock against support members 56. Casters 58 are secured near the distal ends of moving members 54.

Seen in FIG. 5*b* is caster assembly 50 in the extended position. Swivel legs 53 have rotated towards their respective support members 56 to lock in place, thus forcing moving members 54 downwardly a predetermined distance. In this position, casters 58, with their wheel components, protrude from bottom border 24, facilitating the movement of housing 20.

Seen in FIG. 5*c* is tool 60 to operate caster assembly 50. Tool 60 has handle 62 and uniquely shaped end 64 that cooperates with nut 55 of swivel leg 53.

Seen in FIG. 6*a* is bed frame assembly 140 in the retracted position within housing 20. Latch assembly 200 is utilized to keep bed frame assembly 140 retracted within housing 20. End 204 of handle 202 secures over locking member 166 to keep bed frame assembly 140 secure. Also shown in this illustration is caster assembly 50 in the extracted position for housing 20 mobility.

Seen in FIG. 6*b*, bed frame assembly 140 is fully extended and locked whereby operational member 96 is secured within latch 92. Supporting bed frame assembly 140 is support leg assembly 170 and legs 180. Support leg assembly 170 comprises legs 172 and 174, which are secured to hinge support members 156 and 158 respectively. Hinge 176 and leg hinges 173, seen in FIG. 4*a*, allow legs 172 and 174 to collapse towards each other when bed frame assembly 140 is retracted, as seen in FIG. 6*a*. Legs 172 and 174 connect to each other at their distal ends with hinge 175.

Pads 178 are placed thereon to allow bed frame assembly 140 to properly grip flooring and prevent flooring damage.

Seen in FIG. 6*c* is latch assembly 200. Guide 206 guides handle 202 when end 204 is to be moved. Guide 206 and hinge 208 may be secured to the inside face of top panel 22.

Seen in FIG. 7 is an alternate embodiment of the instant invention, defined as instant invention 10'. Instant invention 10' is designed to accommodate larger style mattresses, such as, but not limited to full, queen, and king size. Similar to the embodiment seen in FIG. 1, housing 20' is a furniture piece. In this embodiment, housing 20' has a substantially rectangular shape defined by panels 26'; 30' and others, not seen, establishing a parallel and spaced apart relationship between top panel 22' and bottom border 24". In this embodiment, panel 26' has doors 38'. Handles 40' are ergonomically designed to allow a user to easily open doors 38'. Various combinations of doors and handles may be utilized on housing 20'. As illustrated, doors 38' have been opened, exposing mattress 132' within housing 20'. In the illustrated embodiment, doors 38' have hinges 39'. Additionally, similar to doors 38, seen in FIG. 2, doors 38' have hinges with cooperative characteristics to slide within tracks, not seen, to tuck doors 38' within housing 20'. Handle 118' connects to the bed frame assembly, not seen, and is pulled upon to extend the bed frame assembly out of housing 20'.

In operation, caster assembly 50 may be extended with tool 60. Once fully extended, casters 58, and their accompanying wheel, bearing, or similar assembly, will slightly elevate housing 20. In this position, housing 20 may be easily moved to a desirable location. Once in a desired location, tool 60 is again utilized to retract caster assembly 50. In the retracted position, caster assembly 50 is neatly tucked in, within housing 20, providing a horizontal surface that is more stable.

With caster assembly 50 retracted, the user may safely open doors 38, and tuck them into housing 20, to access the bed. The user may then unlatch latch assembly 200 from locking member 166. Once unlatched, the user pulls on handle 118, extending the bed out from housing 20 until operational member 96 slides into latch 92.

To store the bed into housing 20, the user pulls on end 114 to slide operational member 96 out from latch 92, thus unlocking the frame assembly. The user then lifts with handle 118 and stores the bed into the housing. Retract springs 88 and 109 assist the user when lifting bed frame assembly 140. To secure the bed assembly, latch assembly 200 is re-secured.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A furniture bed assembly, comprising:

A) a housing having first, second, third, and fourth walls contiguously connected and perpendicularly disposed to each other, said housing having first and second ends, said housing further having a fifth wall at said first end and a sixth wall a first predetermined distance from said first end towards said second end without reaching said second end, defining a space therein, whereas said first wall has at least one access door secured to said housing, said third wall has first and second openings, said housing further comprising a caster assembly, said caster assembly having a stationary frame member with first and second swivel legs, and a moving frame member;

B) a stationary frame assembly secured to said housing;

C) a bed frame assembly secured to said stationary frame assembly, said bed frame assembly foldable within and extendable from said housing, said bed frame assembly further having a mattress and locking means to lock said bed frame assembly to said stationary frame assembly when said bed frame assembly is fully extended from said housing; and D) rotating means for rotating said first and second swivel legs through said first and second openings, so that said first and second swivel legs are selectively brought in alignment against said moving frame member thereby elevating said housing, permitting the mobility of said housing on said caster assembly.

2. The furniture bed assembly set forth in claim 1, wherein said rotating means includes a tool, insertable through said first and second openings of said third wall to said first and second swivel legs so that a user exerting a rotational force may configure said caster assembly selectively from a retracted position to an extended position and vice-a-versa.

3. The furniture bed assembly set forth in claim 2, wherein said locking means includes an operational member sliding into a latch assembly of said stationary frame assembly, to lock said bed frame assembly to said stationary frame assembly when said bed frame assembly is fully extended from said housing.

4. The furniture bed assembly set forth in claim 3, wherein said bed frame assembly has storing means to store said bed frame assembly within said housing wherein said bed frame assembly folds within said housing.

5. The furniture bed assembly set forth in claim 4, wherein said locking means further includes a handle secured to said bed frame assembly having a cord with third and fourth ends, said third end secured to said handle and said fourth end secured to said operational member, said handle is pulled by a user causing said operational member to slide out of said latch assembly to unlock said bed frame assembly from said stationary frame assembly, allowing said bed frame assembly to be stored within said housing wherein said bed frame assembly folds within said housing.

6. The furniture bed assembly set forth in claim 5, wherein said stationary frame assembly and said bed frame assembly have springs to facilitate the storage of said bed frame assembly within said housing wherein said bed frame assembly folds within said housing.

* * * * *